United States Patent [19]

Jost

[11] Patent Number: 4,509,980

[45] Date of Patent: Apr. 9, 1985

[54] ELECTRICAL CONTACT MATERIAL COMPRISING SILVER, CADMIUM OXIDE AND CUPRIC SALT

[75] Inventor: Ernest M. Jost, Plainville, Mass.

[73] Assignees: Chemet Corporation, Attleboro, Mass.

[21] Appl. No.: 496,236

[22] Filed: May 19, 1983

[51] Int. Cl.[3] ..... C22C 00/00

[52] U.S. Cl. ..... 75/234; 75/232; 75/233; 200/266

[58] Field of Search ..... 75/232, 233, 234, 235; 200/266

[56] References Cited

U.S. PATENT DOCUMENTS 3,893,820 7/1975 Davies et al. ..... 75/232

3,969,112 7/1976 Kim et al. ..... 75/233 X

FOREIGN PATENT DOCUMENTS 588652 5/1947 United Kingdom ..... 75/233

*Primary Examiner*—Leland A. Sebastian

[57] ABSTRACT

Electrical contacts of high density and high erosion resistance made by sintering a powder compact containing silver, cadmium oxide, cupric nitrate, or any other water soluble copper salt, and optionally silver oxide or silver oxide and barium hydroxide.

9 Claims, No Drawings

ELECTRICAL CONTACT MATERIAL COMPRISING SILVER, CADMIUM OXIDE AND CUPRIC SALT

This invention relates to silver and cadmium oxide powder compacts for use in making electrical contacts and to sintered contacts made therefrom and pertains more specifically to the inclusion of a water soluble cupric salt and, optionally, silver oxide, or silver oxide and barium hydroxide, in such compacts to provide sintered contacts having high density and improved resistance to erosion in use.

In the manufacture of electrical contacts by powder metallurgical procedures, it has been the practice to prepare a powder compact by pressing a mixture of silver powder and cadmium oxide powder to form a powder compact and subsequently heating the compact to sinter it. Forming such compacts at pressures ranging from 4,000 to 20,000 pounds per square inch followed by sintering the compact at a temperature from 850° to 920° C. usually produces a sintered contact material having a density from 85 to 92% of the maximum theoretical density. During use of the contact, for example, in an electrical switching device or circuit breaker, the principal cause of deterioration is erosion of the contact material, the extent of erosion being less in the case of sintered contact material having higher initial density. While it has been the practice to increase the density of such sintered contact materials by mechanical compression procedures such as coining or rolling, thus achieving almost the theoretically maximum density, the resulting product still exhibits inferior electrical contact performance because of its tendency to erode during use. It has also been proposed in Kim et al., U.S. Pat. No. 3,969,112 to add an alkali metal or alkaline earth metal salt such as in nitrate to the powder compact to improve the as-sintered density.

It has now been found that the initial density of the sintered powder compact and its resistance to erosion during use can be increased by including in the powder compact copper nitrate in an amount equivalent to 100 to 500 parts per million of copper metal based on the total weight of silver and cadmium oxide; in a preferred embodiment there is also included from 0.1 to 1.5% by weight of silver oxide and 30 to 100 ppm of barium in the form of barium hydroxide based on the total silver and cadmium oxide.

The powder compact of the present invention comprises a mixture of silver powder and cadmium oxide powder in which the silver amounts to 70 to 95% by weight of the total, preferably 85 to 90%, and the mixture contains from 100 to 500 ppm of copper in the form of a water soluble cupric salt such as the nitrate, sulfate, acetate, or the like, based on the total weight of silver and cadmium oxide. Preferably, the powder compact also includes 0.1 to 1.5% silver oxide by weight and 30 to 100 ppm of barium in the form of barium hydroxide, based on the total silver and cadmium oxide. The presence of alkali or alkaline earth metal salts in the compact has no deleterious effect upon the sintered product and may be desirable in small amounts (up to about 0.5% by weight) in providing a still further increase in initial density.

While I do not wish to be bound by any theory of operation of the present invention, I believe that the increased erosion resistance of the contacts of the present invention results from a decrease in the amount of nitrogen gas entrapped within the sintered contact material. The addition of silver oxide which decomposes at low temperature into silver and oxygen helps to displace the entrapped nitrogen. Such entrapped nitrogen, originating in the atmosphere, is insoluble in the mixture of silver and cadmium oxide and remains within pores of the contact material in compressed form after coining or rolling. As the contact material erodes during the electrical switching and arcing, these compressed nitrogen gas pockets erupt and contribute to excessive spitting type erosion.

The particle size of the powder components of the compact is not critical and powders of conventional particle size can be used, e.g. silver particles from 1 to 3 micrometers in diameter and cadmium oxide particles from 0.5 to 1.5 micrometers in diameter. The cupric salt can itself be mixed with the powder ingredients in the form of a solid powder of approximately the same particle size, i.e. 0.5–3 micrometers, or it can be used in the form of an aqueous solution or a solution in methyl alcohol of any desired concentration which is stirred into the powder mixture. The term cupric salt as used herein includes both the anhydrous salt and the hydrates thereof, e.g. the hexahydrate. The silver oxide when employed can also be in the form of a solid powder of approximately the same particle size as the other powder components.

After mixing in the usual manner, the powder is subjected at room temperature to pressure from 4,000 to 20,000 psi to form a powder compact which can then be sintered in the conventional manner by heating at 850° to 920° C. to form a sintered contact material having a density upwards of 92% of the theoretical and displaying increased erosion resistance during use as compared with similar contacts from which the copper has been omitted.

The following example will serve to illustrate more fully the nature of the invention without acting as a limitation upon its scope.

EXAMPLE 1

There was mixed into 1,000 grams of a conventional mixture of silver powder and cadmium oxide powder in which the silver amounted to 85% by weight of the total, approximately 1.2 grams of cupric nitrate hexahydrate (250 ppm. of copper based on the total weight of silver and cadmium oxide) in solution in methyl alcohol (or optionally in water), and 5 grams of silver oxide powder. The mixture was then subjected at room temperature to a pressure of 10,000 psi to form a powder compact which was then sintered by heating at 900° C. to provide an electrical contact material having an apparent density of 96.5% of the theoretical maximum. When the copper nitrate and silver oxide powder were omitted from the powder compact, the sintered contact material made under the same conditions exhibited an apparent density of only 90% of the theoretical maximum.

The sintered contact materials thus prepared were rolled to a thickness of 0.2 centimeter, then fabricated into contacts one centimeter square and bonded to a copper conductor under identical conditions. The contacts were then tested under identical conditions by switching a current of 750 amps at a potential of 575 volts with a power factor of 35%, and breaking a current of 125 amps at 95 volts with a power factor of 35%. After 600,000 such operations, the contacts of the present invention were found to have lost 0.05 cubic centimeter of their original volume, while the contacts from which the copper sulfate and silver oxide had been omitted lost twice as much, approximately 0.1 cubic centimeters.

EXAMPLE 2

There was mixed into 1,000 grams of a conventional mixture of silver powder and cadmium oxide powder in which the silver amounted to 85% by weight of the total, approximately 1.2 grams of copper sulfate pentahydrate (300 ppm. of copper based on the total weight of silver and cadmium oxide) in solution in methyl alcohol (or water). The mixture was then subjected, at room temperature, to a pressure of 12,000 PSI to form a compact which was then sintered by heating at 900° C. to provide an electrical contact material having an apparent density of 97% of the theoretical maximum. When copper sulfate was omitted from the powder compact, the sintered contact material made under the same conditions, exhibited an apparent density of only 88% of theoretical maximum.

EXAMPLE 3

There was mixed into 1,000 grams of a conventional mixture of silver powder and cadmium oxide powder in which the silver amounted to 85% by weight of the total, approximately 0.62 grams of copper acetate monohydrate (200 ppm. of copper based on the total weight of silver and cadmium oxide) in solution in methyl alcohol (or water) and 64 milligrams of barium hydroxide also in a solution in methyl alcohol (or water). The mixture was then subjected, at room temperature, to a pressure of 10,000 PSI to form a powder compact which was then sintered by heating at 900°0 C. to provide an electrical contact material having an apparent density of 98% of the theoretical maximum. When the copper acetate and the barium hydroxide were omitted from the powder contact, the sintered contact material, made under the same conditions, exhibited an apparent density of only 90% of the theoretical maximum.

I claim:

1. A powder compact for use in making an electrical contact comprising a mixture of silver powder and cadmium oxide powder in which the silver amounts to 70 to 95% by weight of the total and from 100 to 500 ppm of copper, in the form of water soluble cupric salt, based on the total weight of silver and cadmium oxide.

2. A powder compact as claimed in claim 1 comprising in addition from 0.5 to 1.5% by weight of silver oxide powder based on the total weight of silver and cadmium oxide.

3. A powder compact as claimed in claim 2 comprising in addition from 30 to 100 ppm. of barium in the form of barium hydroxide based on the total weight of silver and cadmium oxide.

4. The method of making an electrical contact which comprises providing a powder compact as claimed in claim 1 and sintering it at a temperature of 850° to 920° C.

5. The method of making an electrical contact which comprises providing a powder compact as claimed in claim 2 and sintering it at a temperature of 850° to 920° C.

6. The method of making an electrical contact which comprises providing a powder compact as claimed in claim 3 and sintering it at a temperature of 850° to 920° C.

7. An electrical contact comprising a sintered product of the compact claimed in claim 1.

8. An electrical contact comprising a sintered product of the compact claimed in claim 2.

9. An electrical contact comprising a sintered product of the compact claimed in claim 3.

* * * * *

UNITED STATES PATENT AND TRADEMARK OFFICE

CERTIFICATE OF CORRECTION

PATENT NO. : 4,509,980
DATED : April 9, 1985
INVENTOR(S) : Ernest M. Jost

It is certified that error appears in the above-identified patent and that said Letters Patent are hereby corrected as shown below:

Column 3, line 34, "900°0C." should be --900°C.--;

Column 3, line 38, after "powder", "contact" should be --compact--.

Signed and Sealed this

*Thirteenth* Day of *August 1985*

[SEAL]

*Attest:*

DONALD J. QUIGG

*Attesting Officer* *Acting Commissioner of Patents and Trademarks*